US005615720A

United States Patent [19]

O'Sullivan

[11] Patent Number: 5,615,720

[45] Date of Patent: Apr. 1, 1997

[54] GOLF CLUB CLEANING COVER

[76] Inventor: Kevin P. O'Sullivan, 4 Bridle Path Dr., Old Westbury, N.Y. 11568

[21] Appl. No.: 427,445

[22] Filed: Apr. 24, 1995

[51] Int. Cl.[6] ..... A63B 57/00

[52] U.S. Cl. ..... 150/160; 206/315.2; 206/315.4

[58] Field of Search ..... 206/315.2, 315.4; 150/159, 160

[56] References Cited

U.S. PATENT DOCUMENTS

| | | | |
|---|---|---|---|
| 3,023,795 | 3/1962 | Denkert | 150/160 |
| 3,117,609 | 1/1964 | Pio | 150/160 |
| 3,406,419 | 10/1968 | Young | 15/104.94 |
| 3,831,652 | 8/1974 | Hyden et al. | 150/160 |
| 3,938,570 | 2/1976 | Stewart | 150/160 |
| 4,498,579 | 2/1985 | Brick | 206/315.4 |
| 4,971,126 | 11/1990 | Borenstein | 150/160 |
| 5,050,655 | 9/1991 | Borenstein | 150/160 |
| 5,146,968 | 9/1992 | Meek | 150/160 |
| 5,215,136 | 6/1993 | Flanders et al. | 150/160 |
| 5,297,603 | 3/1994 | Meek | 150/160 |
| 5,322,105 | 6/1994 | Meek | 150/160 |

FOREIGN PATENT DOCUMENTS

| | | | |
|---|---|---|---|
| 12382 | 1/1914 | United Kingdom | 206/315.2 |
| 1360058 | 7/1974 | United Kingdom | 206/315.2 |

*Primary Examiner*—Sue A. Weaver
*Attorney, Agent, or Firm*—Scully, Scott Murphy and Presser

[57] ABSTRACT

A cover for a golf club having, disposed on the interior surface thereof, at least one abrasive surface for removing debris and dirt which collects on the head of the club during play. In one embodiment the cover is a flexible sock-shaped structure, generally fitted to the shape of a driver, having a pair of abrasive surfaces, such as arrays of plastic bristles, which are positioned on the interior surface of the sock-shaped structure to correspond to the striking surface and the sole of the club head. In a second embodiment the cover is a hard plastic sheath, generally fitted to the shape of an iron, having a pair of abrasive surfaces, such as arrays of brass bristles, which are positioned on the interior surface of the hard plastic shell to correspond to the striking surface and the sole of the club head.

15 Claims, 6 Drawing Sheets

GOLF CLUB CLEANING COVER

BACKGROUND OF THE INVENTION

1. Field of the Invention

The present invention relates to a cleaning cover for a golf club. More particularly, the present invention relates to a golf club head cover having a plurality of interiorly disposed abrasive surfaces for cleaning selected portions of a golf club head of dirt and other foreign matter.

2. Discussion of the Prior Art

The game of golf is played on an expansive grass surface, referred to as a "course". A golf course is divided into a multiplicity of separate segments, referred to as "holes". Each hole comprises an elongate field of play, referred to as a "fairway" which separates the starting point from the cup. The standard golf course includes eighteen holes, the completion of which, by a golfer, is called a "round".

The equipment required to play a round of golf includes a small, hard, solid, spherical ball and a plurality of different sized clubs. Each club is generally an elongate shaft having a hand grip at one end and a shaped hitting surface at the other end. The game of golf is played by attempting to successfully hit the ball with successive strikes, ultimately causing the ball to fall into a recessed cup disposed at the distal end of the fairway from the starting point. As each successive hit brings the ball closer to the cup, different strength and placements are required of the next hit. It is, therefore common for the golfer to have a variety of different clubs with which to hit the ball in accordance with the appropriate distance and accuracy for that hit. Each hit, called a "stroke", is recorded; the object of the game being to require the fewest strokes to sink the ball in the cup of each hole. Each of the holes of the course is played in sequence, and at the completion of the round, the total number of strokes is computed for each player, therein producing a measurable and comparable score.

It is often the case that a golfer, during the act of hitting the ball with one of the clubs, will simultaneously hit the grassy surface of the course, therein lifting a clump of grass and dirt, called a "divot". This is a correspondingly more likely event according to the speed and strength with which the golfer attempts to hit the ball. After having lifted a divot, however, the head of the club is usually coated with a layer of dirt and grass. This dirt and grass, if not removed prior to the next use, may throw off the balance of the club, or may cause irregularities in the morphology of the hitting surface, or may even fly free of the club during the next swing producing a dispersion of dirt and grass particles into the immediately surrounding area.

There are a variety of devices which are known which comprise both a golf club head covering means and a head polishing surface. U.S. Pat. No. 3,406,419 to Young teaches one such a device. Such devices, however, are suited for removing only the finest particulate matter from the head of the club, not for removing gross debris and dirt. Polishing head covers are, therefore, lacking in the utility to which the present invention is directed.

Devices known in the art for removing the gross foreign matter from the hitting surface of the club include towels, brushes, and hand tools for removing embedded dirt. In particular, U.S. Pat. Nos. 5,146,968, 5,297,603, and 5,322,105 to Meek teach a covering for a golf club head comprising a towel section having a plurality of engaging VELCRO strips for securably wrapping the towel about the head of the club. The towel of the Meek references also includes a club head scrubber pad which may be used to clean the head of the club prior to wrapping around the head of the club.

U.S. Pat. Nos. 4,971,126 and 5,050,655 to Borenstein teach a semi-rigid, flexible plastic cover for a golf club head having a brush and a scraper integrally attached to the external surface of the cover. In using either of the Borenstein devices, a golfer would manually scrape and/or brush the debris from the golf club, using the external means attached to the cover, prior to inserting the club into the cover.

The use of such devices as are described above, to remove the dirt and grass from a golf club head, requires the golfer to directly touch the dirt and grass via an external scrubbing device. If this cleaning is required during the round of golf, the golfer often times must bring a towel or other means for cleaning his hands or risk a variety of undesirable things occurring, e.g., dirtying his clothes, destroying his golfing gloves, or even rendering slippery his grip on the club handle therein heightening the endanger to other players from his subsequent swings.

In addition, there exists a strong sense of pride amongst golfers with respect to the cosmetic appearance of their golfing equipment. This is especially true of their golf bags, clubs, and golf club covers. The devices described above, which incorporate cleaning means with a golf club cover, fail to provide a clean and attractive appearance during or after use as they are covered with the dirt and grass debris which has been removed from the club head.

It is therefore an object of the present invention to provide a golf club head cover which also incorporates a cleaning means for removing dirt and other debris from the head of a golf club which reduces the user's risk of dirtying himself or his equipment, or of losing his grip during his swing as a result of dirty hands.

It is also an object of the present invention to provide a golf club head cover and cleaning means which retains a clean and attractive appearance while simultaneously removing dirt and grass from the head of the club.

Other objects and advantages of the invention will be more fully apparent from the ensuing disclosure and appended claims.

SUMMARY OF THE INVENTION

In accordance with the objects recited above, the present invention provides a golf club head cover having a plurality of abrasive surfaces incorporated therewith for cleaning dirt and other debris from surfaces of the head of the golf club, which does not cause the user to dirty his hands, clothes, club handle or the cover itself. In one embodiment, the present invention comprises a portion of flexible material, such as leather, canvas, or knitted materials having a generally water resistant nature, having a sock shape for receiving therein the head of a golf club. Disposed on the interior surface of the flexible sock are a plurality of abrasive pads which can be used to clean dirt and debris from the head of the club.

By inserting the head of the club into the cover, and subsequently manipulating the cover so that the interiorly disposed abrasive surfaces are caused to rub against the corresponding surfaces of the head of the club, the user of the present invention may clean collected debris from his club without dirtying himself, or detracting from the appearance of the exterior of the cover. During use, the dirt and other particulate matter which is cleaned from the surface of the club head flows out of the cover through the open end and falls to the ground.

In a highly preferred variation of this embodiment of the present invention the abrasive portions of the interior surface of the cover are positioned such that the portions of the club head which are cleaned are the striking surface and the sole plate.

The abrasive portion of the interior surface of the club head cover comprises abrasive elements, including, but not limited to, brass bristles, plastic bristles, carborundum, or steel wire pads.

A second embodiment of the present invention, which is specifically suited to one type of club, the iron, comprises a semi-rigid sheath which may be positioned about the club head. This embodiment comprises at least one abrasive surface, similar to the embodiment described above, disposed on the interior of the cover for removing dirt and debris from surfaces of the club head.

BRIEF DESCRIPTION OF THE DRAWINGS

FIG. 1*a* is a perspective view of a one type of golf club which may be covered and cleaned by the present invention, while

DETAILED DESCRIPTION

Figure 1A:
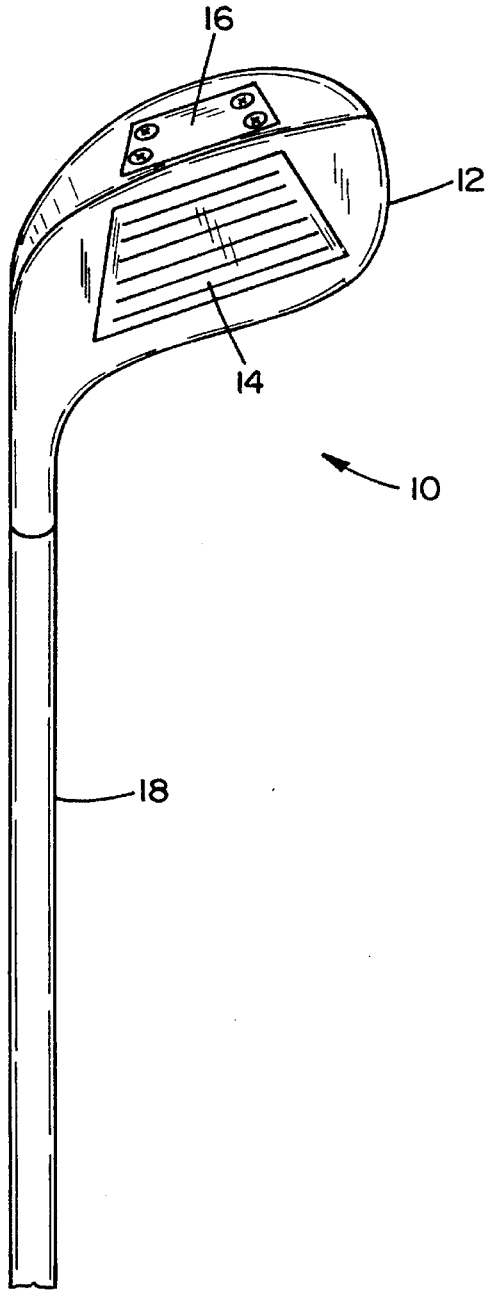

Referring now to FIG. 1*a*, a golf club 10 is illustrated in a perspective view. Golf clubs come in a variety of shapes, sizes, and construction; each having a specific design which relates to the need of the golfer with respect to the position of his ball on the course. For example, the golf club shown in FIG. 1*a* is a driver, which is most commonly used to make the initial hit during the play at a specific hole. Modern drivers, often referred to as woods because they were traditionally constructed of a hard wood, are of two types, ones retaining a wooden striking end and those constructed entirely of metal. The former type, which retain a wooden striking ends generally are constructed with a metal striking plate 14 and a metal base plate 16 attached to the bottom of the head 12. These metal surfaces are included in order to properly balance the club, to protect the club from undue wear and tear over the life of the club, and to inhibit undesirable vibration in the shaft 18 after contact is made between the striking plate 14 and the ball (not shown). The latter type of driver, which is constructed entirely of metal, necessarily includes a metal striking surface and a metal base portion.

Figure 1B:
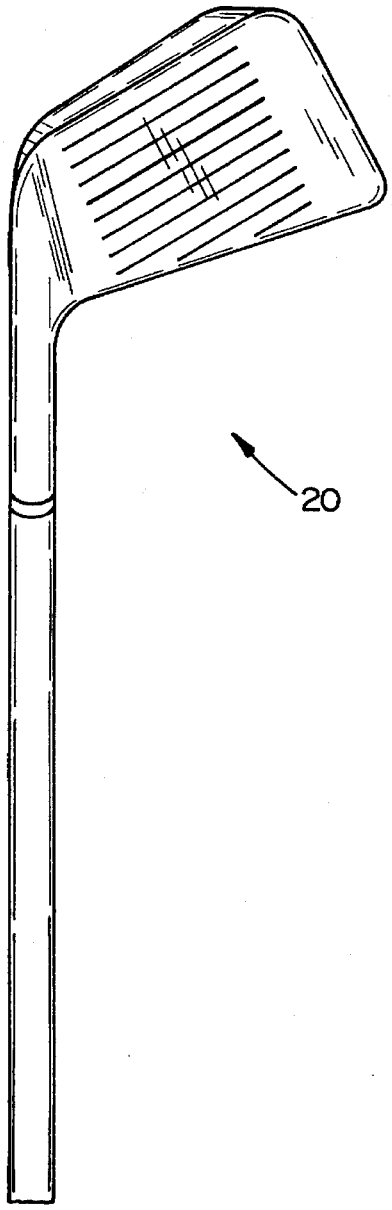
FIG. 1*b* is another type of golf club to which the present invention is directed.

Referring now to FIG. 1*b*, a second golf club 20, which is of a different type from the above described driver, is shown in a perspective view. This club, which is generally referred to as an iron, is designed for use by a golfer when hitting his ball from a position at a midpoint between the initial point and the cup. This type of club is referred to as an iron because it has traditionally been made entirely of metal, having no wooden surfaces.

Figure 2A:
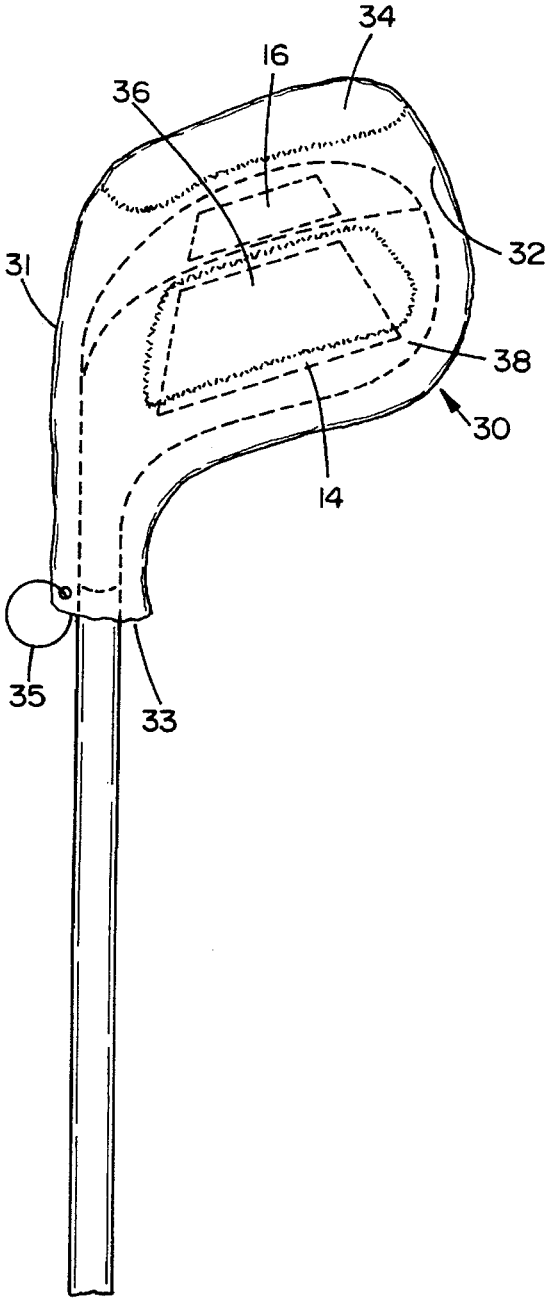
FIG. 2*a* is a perspective view of one aspect of the present invention having a golf club of the type shown in FIG. 1*a* inserted within it.
Figure 2B:
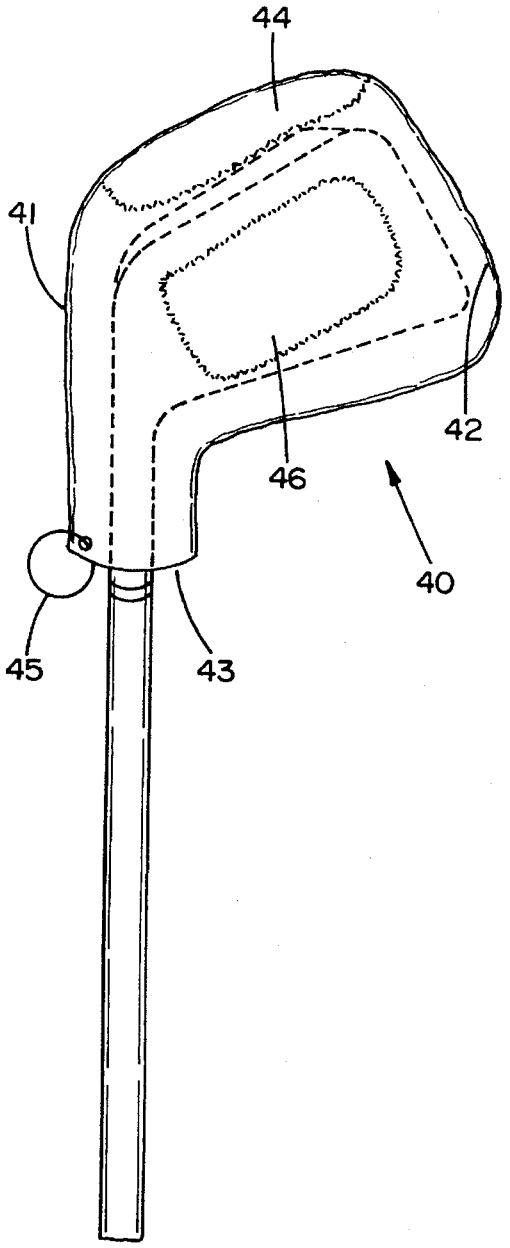
FIG. 2*b* is a perspective view of another aspect of the present invention having a golf club of the type shown in FIG. 1*b* inserted within it.

Referring now to FIGS. 2*a* and 2*b*, two variations of a first embodiment of the golf club cleaning cover is illustrated wherein they are covering the heads of corresponding clubs 10, 20. The club of FIG. 2*a* is a driver, while the club of FIG. 2*b* is an iron. Both covers are similar in overall shape, and have similar requirements for outer surface material 31, 41. The sock shaped cover is a flexible material and may comprise leather, canvas, plastic, knitted cloth, etc. The cover is open at its top 33, 43 (which is inverted in use) at a location which is a short distance up the shaft of the club from the head so that the cover will remain in position while the club is carried or otherwise moved along within a golf bag. In addition, the covers are usually equipped with ring attachments 35, 45 through which a connecting line (not shown) may be threaded which couples a plurality of head covers together, therein preventing misplacement of a single cover.

In the embodiment of FIG. 2*a*, the cleaning cover 30 includes on its interior surface 32 two abrasive surfaces 34 and 36. It is understood that the interior surface of the cover 30 could include only a single abrasive surface or a multiplicity of abrasive surfaces, depending upon the specific requirements for use. In the embodiment of FIG. 2*a*, which shows the cover 30 in use with a driver, or wood 10, the material of the abrasive surfaces 34, 36 comprises a substance which is capable of removing dirt and debris from the striking surface 14 and the sole plate 16 without scratching or otherwise damaging the adjacent wooden surfaces 38. Examples of acceptable abrasive surface materials include arrays of flexible plastic bristles, or low abrasive steel wool. It is understood that a variety of alternate materials, providing the same function as the above cited bristles or steel wool, which would not mar the more delicate surfaces of the driver, are available. The use of such alternate materials is anticipated and encompassed by the broad scope of this invention.

Referring now to FIG. 2*b*, which is similar in most respects to the embodiment illustrated in FIG. 2*a*, but for the differences related to the type of club. In the embodiment of FIG. 2*b*, the cleaning head cover 40 includes on its interior surface 42 a first abrasive surface 44 positioned adjacent to the sole face of the club and a second abrasive surface 46 positioned adjacent to the ball striking face of the club. In this figure, the club is an iron, which by its nature does not become scratched or disfigured so easily as a wood driver. It is, therefore, permissible and desirable to select from a wider variety of abrasive material surfaces, e.g., arrays of brass bristles, resilient hard plastic bristles, carborundum pads, etc., as well as the materials described above with respect to the covers for drivers.

Figure 3:
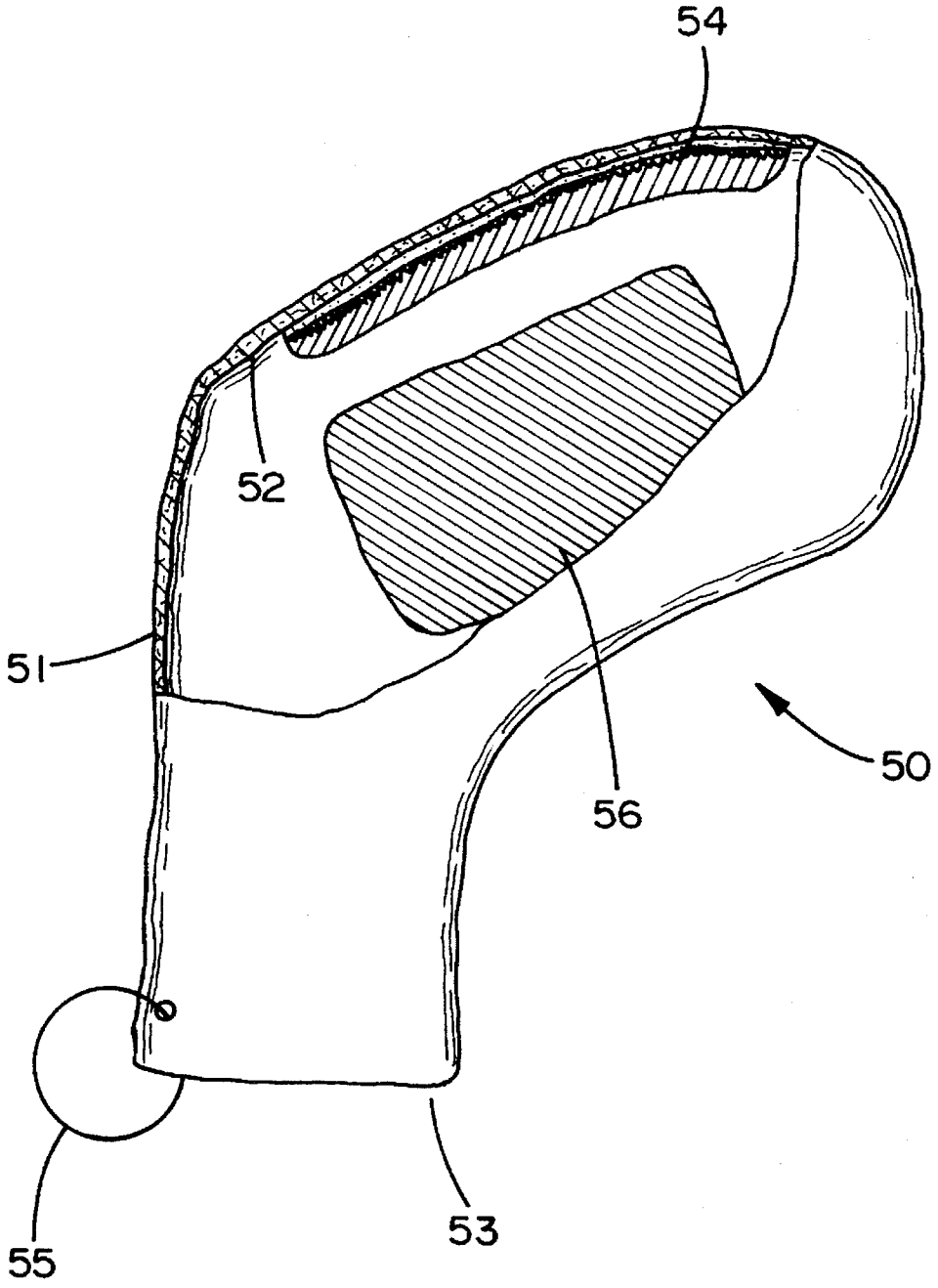
FIG. 3 is a perspective view of the interior surface of one embodiment of the present invention.

Referring now to FIG. 3, a cut-away view of this embodiment of the club cleaning cover which shows the interior of the cover 50, and the abrasive pads therein, is provided. The cover 50 is generally sock-shaped in appearance, having an open end 53 and an otherwise continuous surface 51 which covers the head of a club inserted therein. Abrasive pads 54, 56 are disposed at the two locations within the cover which correspond to where the sole plate and the striking surface of the club would be positioned if a club were inserted into the cover.

It is understood that golf clubs are designed for both left handed and right handed golfers, the difference in the clubs being important for the covers of the present invention. The covers for right handed clubs have an interior surface which touches the striking surface at a position diametrically opposing that of covers for left handed clubs. It is, therefore, important either to select the appropriate cover for the appropriate club, or to construct an embodiment of the present invention having three abrasive surfaces (one for the sole plate, one for a right handed striking surface, and one for an alternative left handed striking surface), or to choose an embodiment which has a single abrasive surface covering the entire interior of the cover. In such an embodiment, it is highly preferred to choose an abrasive pad material which will not damage the surface of the driver which corresponds to the third pad (the pad which is included for use with a club of the opposite orientation).

Figure 4:
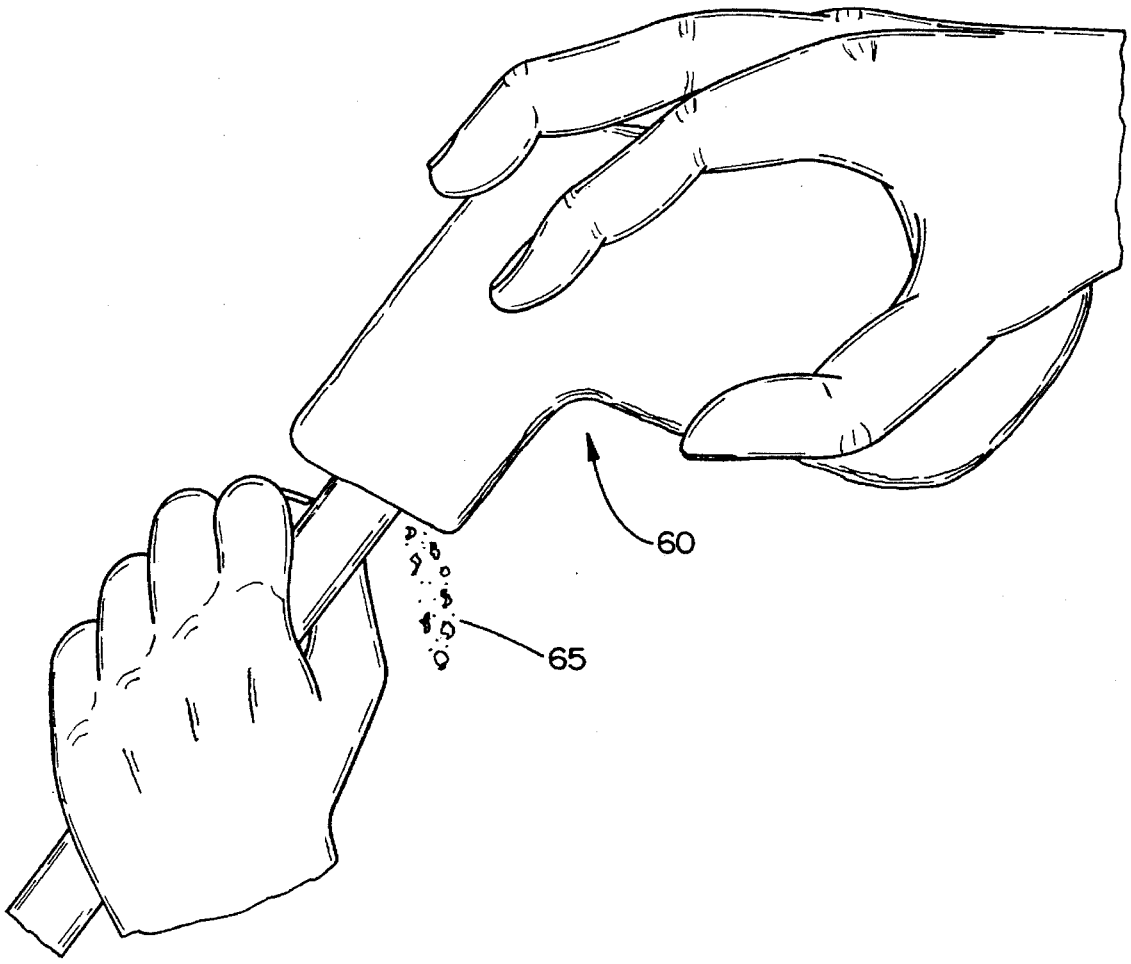
FIG. 4 is a perspective view of one aspect of the present invention being manipulated in accordance with the utility thereof by a user.

Referring now to FIG. 4, the cover 60 of the present invention is shown in use by a user in a perspective view. In use, a golfer, having identified a coating of dirt or debris on his club would insert the head of the club into the cover 60. With one hand grasping the shaft of the club in order to support the club, the golfer manipulates the clean outer surface of the cover (as shown) in a reciprocating, cyclical, or random motion therein permitting the interior abrasive surfaces to contact, dislodge and remove the dirt and debris from the necessary surfaces.

Figure 5:
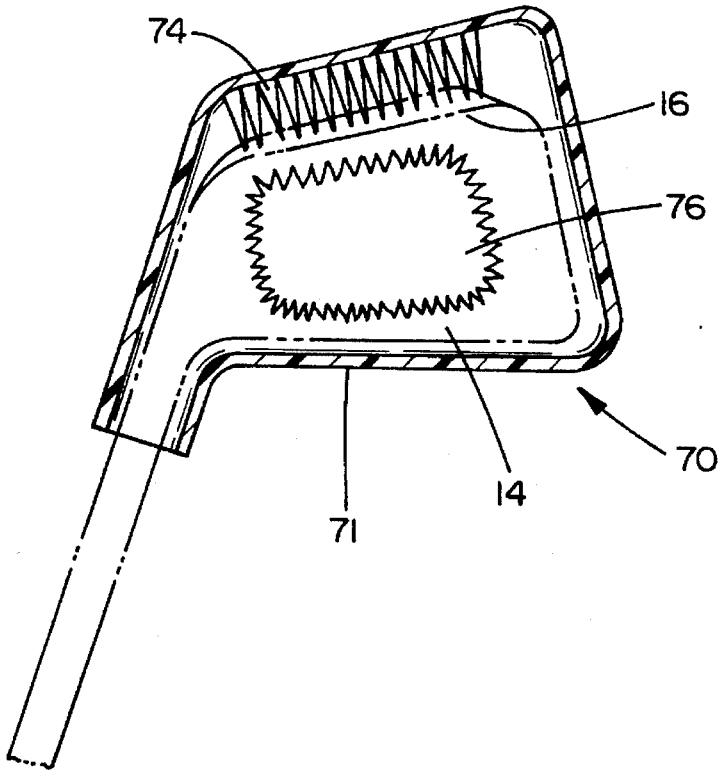
FIG. 5 is a perspective view of another aspect of the present invention, having a golf club of the type shown in FIG. 1*b* inserted into it.

Referring now to FIG. 5, a semi-rigid cleaning cover which is an alternative embodiment of the present invention is shown in a perspective view. This cover embodiment is specifically designed for use with irons, as opposed to drivers, having a sheath-like shape and a semi-rigid shell structure 71. Such a shell may be constructed, for example, of a hard plastic. The cover 70 has, disposed on its interior surface, a pair of abrasive surfaces 74, 76 which correspond to the striking surface 14 and the metallic sole 16.

Figure 6:
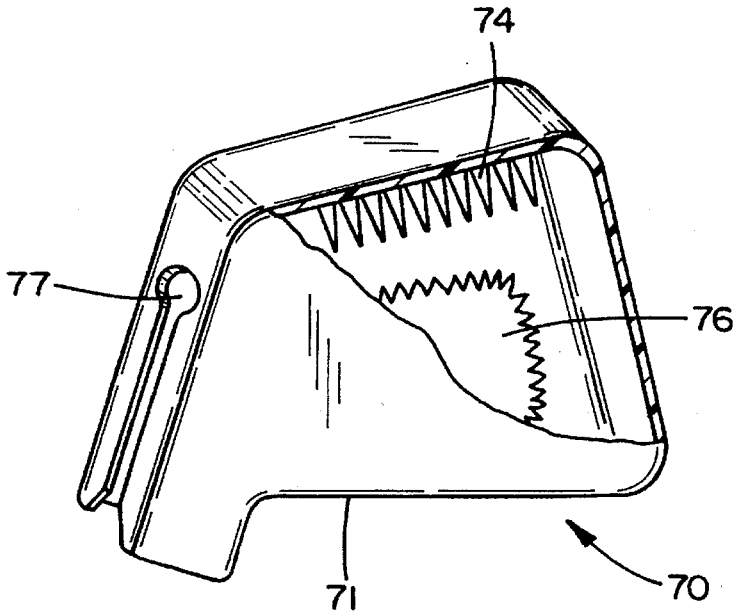
FIG. 6 is a cutaway view of the aspect of the present invention shown in FIG. 5.

Referring now to FIG. 6, a cut-away view of the cover shown in FIG. 5 is shown. The cover includes a side opening 77 through which the club head may be inserted. The action of inserting the club head causes the abrasive surfaces 74, 76 to contact the corresponding surfaces of the club, therein cleaning the dirt and debris which was coating the surface thereof.

Figure 7:
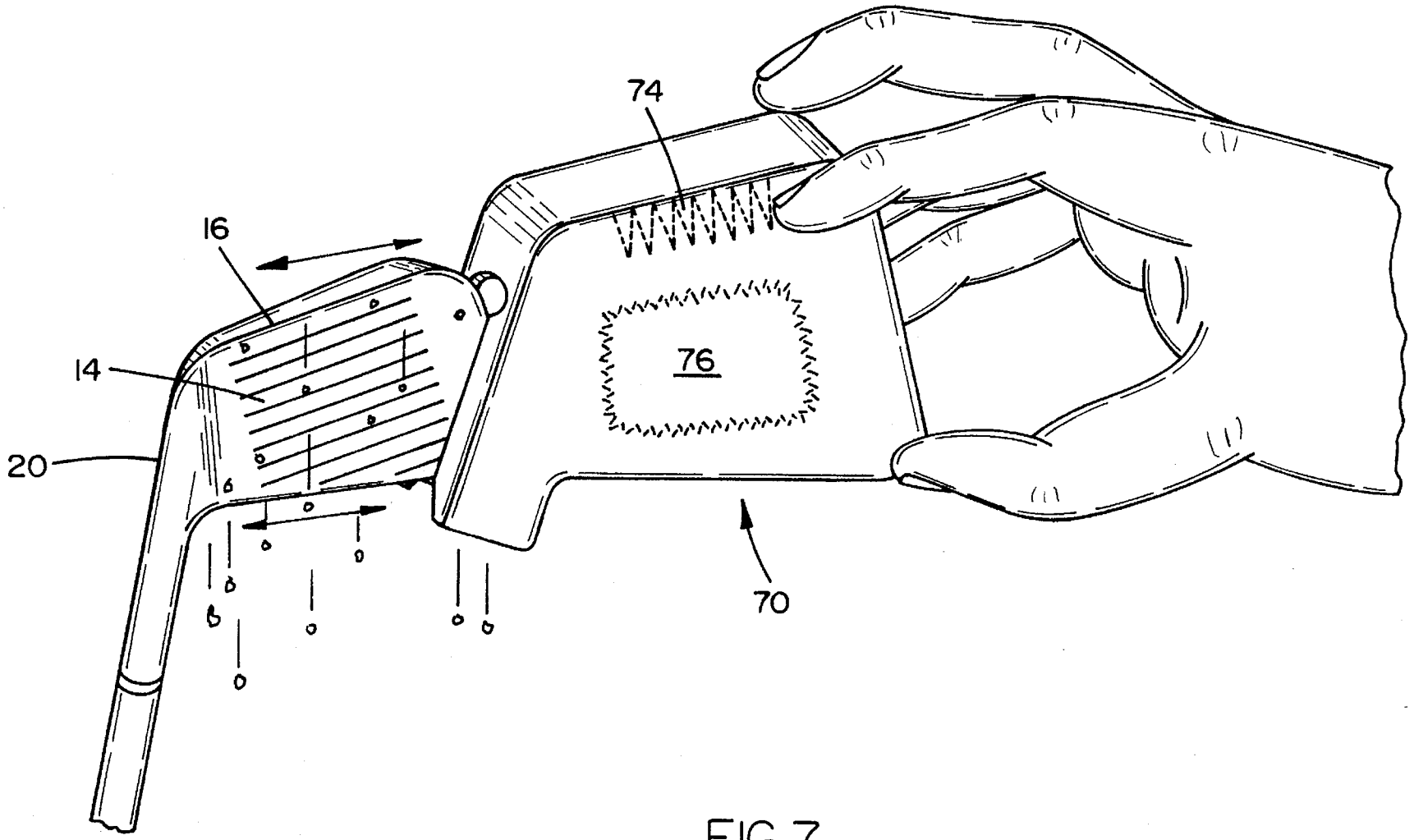
FIG. 7 is a perspective view of the aspect of the present invention shown in FIG. 5 in use.

Referring now to FIG. 7, an illustration of the use of this embodiment of the present invention is shown in a perspective view. The action of reciprocating the club head into and out of the cover 70 provides the relative motion by which the abrasive surfaces 74, 76 may abrade away the dirt and debris which had collected on the club head.

As this embodiment of the club cover is intended to be used with irons only, it is desirable for the abrasive surfaces to be selected from the list of suitable materials described above with respect to the variation of the first embodiment relating to irons.

While there has been described and illustrated specific golf club head cleaning covers for cleanly removing dirt and debris from a golf club while simultaneously being an attractive and functional cover therefore, it will be apparent to those skilled in the art that variations and modifications are possible without deviating from the broad spirit and principle of the present invention which shall be limited solely by the scope of the claims appended hereto.

What is claimed is:

1. An apparatus for cleaning and removably covering a golf club head having a front ball striking face and a bottom sole face which should be cleaned by removing debris and dirt which collects thereon during golf play, and other surface faces, comprising a flexible sock shaped cover member which can receive therein a golf club head, a first abrasive surface disposed on an inner surface of said cover member positioned in abrading contact relation to the ball striking face of the golf club head, a second abrasive surface disposed on an inner surface of said cover member positioned in abrading contact relation to the sole face of the golf club head, and wherein the other surface faces of the golf club head are contacted by nonabrasive surfaces of the cover member.

2. The apparatus set forth in claim 1, wherein each of said abrasive surfaces comprises an array of brass bristles.

3. The apparatus set forth in claim 1, wherein each of said abrasive surfaces comprises resilient hard plastic bristles.

4. The apparatus set forth in claim 1, wherein each of said abrasive surfaces comprises a carborundum pad.

5. The apparatus set forth in claim 1, wherein each of said abrasive surfaces comprises steel wool.

6. The apparatus set forth in claim 1, wherein the other surface faces of the golf club head include a rear surface face, a top surface face, and side surface faces.

7. The apparatus set forth in claim 1, wherein said first and second abrasive surfaces are formed by separate abrasive patches adhered to the inner surface of the cover member.

8. An apparatus for cleaning and removably covering a golf club head, having a front ball striking face and a bottom sole face which should be cleaned by removing debris and dirt which collects thereon during golf play, and other surface faces, comprising a semi-rigid sheath cover member which can receive therein a golf club head, a first abrasive surface disposed on an inner surface of said cover member positioned in abrading contact relation to the ball striking face of the golf club head, a second abrasive surface disposed on an inner surface of said cover member positioned in abrading contact relation to the sole face of the golf club head, and wherein the other surface faces of the golf club head are contacted by nonabrasive surfaces of the cover member.

9. The apparatus set forth in claim 8, wherein said semi-rigid sheath member comprises a hard plastic shell.

10. The apparatus set forth in claim 8, wherein each of said abrasive surfaces comprises an array of brass bristles.

11. The apparatus set forth in claim 8, wherein each of said abrasive surfaces comprises resilient hard plastic bristles.

12. The apparatus set forth in claim 8, wherein each of said abrasive surfaces comprises a carborundum pad.

13. The apparatus set forth in claim 8, wherein each of said abrasive surfaces comprises steel wool.

14. The apparatus set forth in claim 8, wherein the other surface faces of the golf club head include a rear surface face, a top surface face, and side surface faces.

15. The apparatus set forth in claim 8, wherein said first and second abrasive surfaces are formed by separate abrasive patches adhered to the inner surface of the cover member.

* * * * *